US008863325B1

(12) United States Patent
Fiterson

(10) Patent No.: US 8,863,325 B1
(45) Date of Patent: Oct. 21, 2014

(54) UNDULATING BED

(76) Inventor: Naum Fiterson, Brooklyn, NY (US)

( * ) Notice: Subject to any disclaimer, the term of this patent is extended or adjusted under 35 U.S.C. 154(b) by 358 days.

(21) Appl. No.: 13/363,730

(22) Filed: Feb. 1, 2012

(51) Int. Cl.
*A61G 7/008* (2006.01)

(52) U.S. Cl.
USPC ..... 5/5; 5/108; 5/109

(58) Field of Classification Search
USPC ..... 5/105–109, 607, 609
See application file for complete search history.

(56) References Cited

U.S. PATENT DOCUMENTS

| | | | |
|---|---|---|---|
| 2,979,735 | A | 4/1961 | Helmer |
| 3,031,687 | A | 5/1962 | Stevens et al. |
| 3,654,918 | A | 4/1972 | Blok et al. |
| 4,087,872 | A | 5/1978 | Smirle |
| 5,572,752 | A | 11/1996 | McGee |
| 5,845,350 | A | 12/1998 | Beemiller et al. |
| 6,155,976 | A | 12/2000 | Sackner et al. |
| 7,404,221 | B2 | 7/2008 | Sackner |
| 2010/0222724 | A1 * | 9/2010 | Huang ..... 601/115 |

FOREIGN PATENT DOCUMENTS

| | | |
|---|---|---|
| CN | 2.593.762 | 12/2003 |
| CN | 2.798.917 | 7/2006 |
| CN | 201274913 | 7/2009 |
| FR | 2.828.410 | 2/2003 |

* cited by examiner

*Primary Examiner* — Fredrick Conley
(74) *Attorney, Agent, or Firm* — Michael I. Kroll

(57) ABSTRACT

An undulating bed comprises a padded mattress. A bed frame support is positioned under the padded mattress. A mechanism within the bed frame support is for imparting an undulating/rocking motion to the padded mattress, to substantially simulate motion experienced on a boat as a sleep aid to a user lying on the padded mattress.

13 Claims, 8 Drawing Sheets

UNDULATING BED

BACKGROUND OF THE INVENTION

1. Field of the Invention

The present invention relates generally to vibrating beds and, more specifically, to an undulating bed that provides an undulating/rocking motion from side to side and/or front to back. Most beds that provide motorized stimulation utilize vibration to stimulate the user. The present invention provides a plurality of U-shaped springs constrained by spring rails connected through adjustable linkage arms to pivot plates driven by variable RPM motors to create an undulating/rocking side-to-side and/or front to back movement to substantially simulate motion experienced on a boat as a sleep aid to a user.

2. Description of the Prior Art

There are other motorized devices for beds. While these devices may be suitable for the purposes for which they where designed, they would not be as suitable for the purposes of the present invention as heretofore described.

SUMMARY OF THE PRESENT INVENTION

A primary object of the present invention is to provide an undulating bed comprising a bed frame support and padded mattress with an internal spring frame incorporating a plurality of U-shaped springs constrained by two spring frame rails having a free sliding curved member fastened between the spring frame rails supported on a structural frame curved surface support of the bed frame support and a bed frame, housing a pair of variable RPM motors with one motor having adjustable linkage arms exerting a side-to-side force on the padded mattress spring frame rails and the other variable RPM motor having adjustable linkage arms exerting a force fore-to-aft on a front and rear U-shaped spring, so that when the variable RPM motors are energized the padded mattress is provided with undulating/rocking motions likened to the movement experienced on a boat that is intended as a sleeping aid for users.

Another object of the present invention is to provide an undulating bed wherein the spring frame provides a plurality of transverse U-shaped springs beneath the padded mattress.

Yet another object of the present invention is to provide an undulating bed wherein the spring frame further provides a plurality of coil springs fixedly attached onto top portions of the plurality of transverse U-shaped springs serving as the typical mattress spring support.

Still yet another object of the present invention is to provide an undulating bed wherein the spring frame also provides a pair of longitudinal spring frame rails having spaced apart apertures each receiving a leg of the plurality of transverse U-shaped springs.

A further object of the present invention is to provide an undulating bed wherein the spring frame additionally provides a plurality of polymeric or elastomeric members extending across the base of each of the rail apertures forming support for each of the legs of the plurality of U-shaped springs.

A yet further object of the present invention is to provide an undulating bed wherein the spring frame additionally has a free sliding curved member with a longitudinally curved top surface and downwardly extending walls that are fastened to opposing spring frame rails basically serving as support for the padded mattress spring frame and as a curved surface for a somewhat rocking motion impinged on the padded mattress spring frame via adjustable linkage arms extending between front end and back end U-shaped springs and adjustable linkage arms extending from the opposing spring frame rails and the respective pivot plates of the variable RPM motors.

A still yet further object of the present invention is to provide an undulating bed having a bed frame support comprising a bed frame and a structural frame curved surface support.

An additional object of the present invention is to provide an undulating bed wherein the bed frame houses a pair of variable RPM motors providing means for impinging movement of the padded mattress spring frame through adjustable linkage arms attached to the spring frame rails and adjustable linkage arms attached to a front end and rear end U-shaped spring.

An additional object of the present invention is to provide an undulating bed wherein the bed frame houses a pair of variable RPM motors, each having a pivot plate with divergent adjustable linkage arms connected to opposing spring frame rails and adjustable linkage arms attached to a front end and rear end U-shaped spring.

Another object of the present invention is to provide an undulating bed wherein the adjustable linkage arms provides means for adjusting the amount of force impinged upon the spring frame rails and therefore the U-shaped springs constrained by the spring frame rails.

Yet another object of the present invention is to provide an undulating bed wherein the adjustable linkage arms comprises a tension rod having an inter-disposed elastic member with one end of the tension rod fastened to a spring frame rail and the other fastened to the pivot plate.

Still yet another object of the present invention is to provide an undulating bed wherein the structural frame curved surface support has a corresponding curved top surface as the free sliding curved member of the spring frame.

Another object of the present invention is to provide an undulating bed having a controller for energizing and de-energizing the variable RPM motors.

Yet another object of the present invention is to provide an undulating bed wherein the controller further contains a switch for varying the RPM's of the variable RPM motors when employed.

It is further intended that the present invention is not limited to a specific embodiment of the pivot plate as depicted in the accompanying drawing for turning rotational motion into reciprocal motion as there are many similar devices well known within the art for translating rotational motion to reciprocating motion.

Additional objects of the present invention will appear as the description proceeds.

The present invention overcomes the shortcomings of the prior art by providing an undulating bed that selectively undulates in side-to-side motion and front-to-back motion through incorporation of at least two variable RPM motors connected both transversely and longitudinally to a respective padded mattress spring rail and front end and rear end U-shaped springs.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

In order that the invention may be more fully understood, it will now be described, by way of example, with reference to the accompanying drawing in which.

DESCRIPTION OF THE REFERENCED NUMERALS

Figure 1:
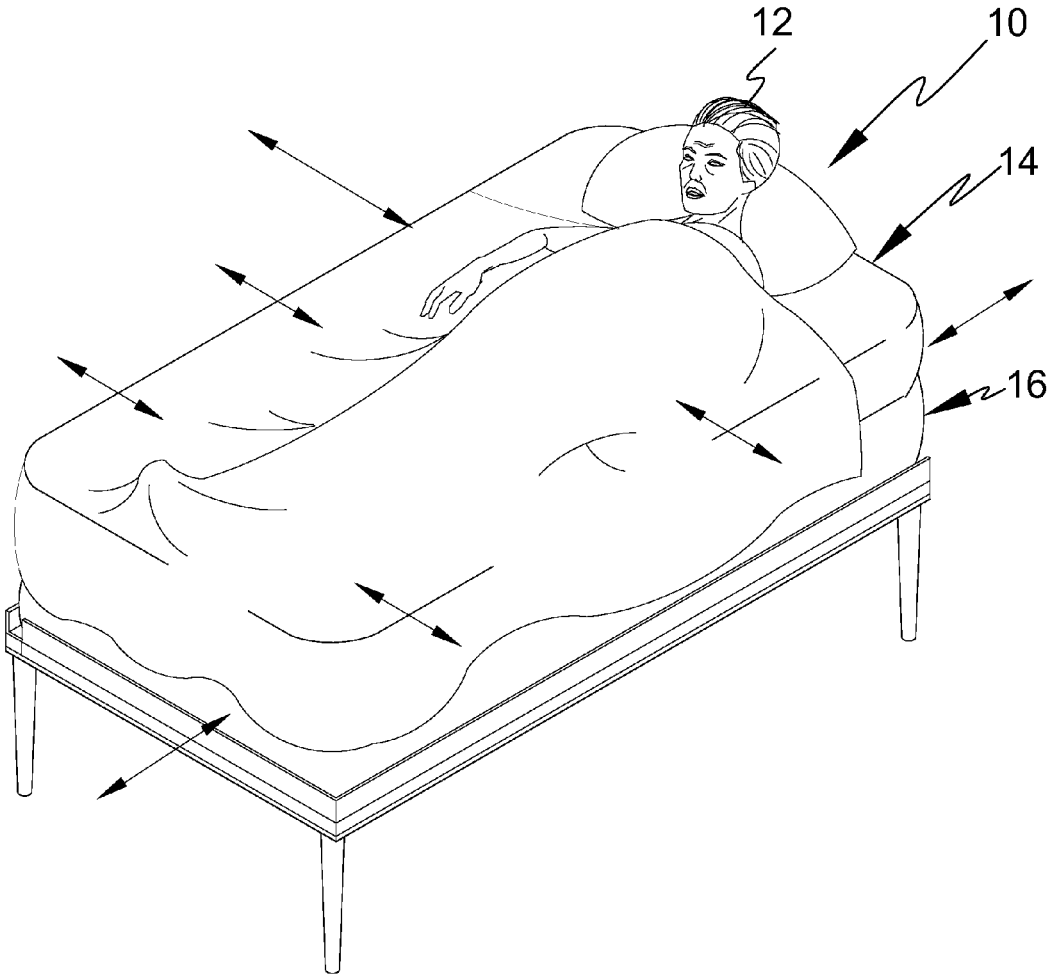
FIG. 1 is an isometric view of the present invention in use.

Turning now descriptively to the drawings, in which similar reference characters denote similar elements throughout the several views, the Figures illustrate the undulating bed of the present invention. With regard to the reference numerals used, the following numbering is used throughout the various drawing figures.

10 undulating bed
12 user
14 padded mattress
16 bed frame support
18 spring frame
20 adjustable linkage arm
22 variable RPM motor
24 spring frame rail
26 aperture
28 elastic band
30 U-shaped spring
32 coil spring
34 top portion
36 leg portion
38 free sliding curved member
40 structural frame curved surface support
42 bed frame
44 pivot plate
46 tension rod
48 elastic member
50 gear box
52 elastomeric/polymeric
54 controller
56 switch

DETAILED DESCRIPTION OF THE PREFERRED EMBODIMENT

The following discussion describes in detail one embodiment of the invention. This discussion should not be construed, however, as limiting the invention to those particular embodiments, practitioners skilled in the art will recognize numerous other embodiments as well. For definition of the complete scope of the invention, the reader is directed to appended claims.

Referring to FIG. 1, shown is an isometric view of the present invention in use. The present invention is an undulating bed 10 for simulating an undulating/rocking motion experienced on a boat, which will serve as a sleep aid to a user 12. The undulating bed 10 comprises a padded mattress 14 that sits atop a bed frame support 16. The padded mattress 14 encompasses a spring frame 18 connected through adjustable linkage arms 20 to variable RPM motors 22 housed with the bed frame support 16. The adjustable linkage arms 20 connect to the spring frame 18 in transverse and longitudinal fashion, thereby imparting the undulating/rocking motion to the padded mattress 14.

Figure 2:
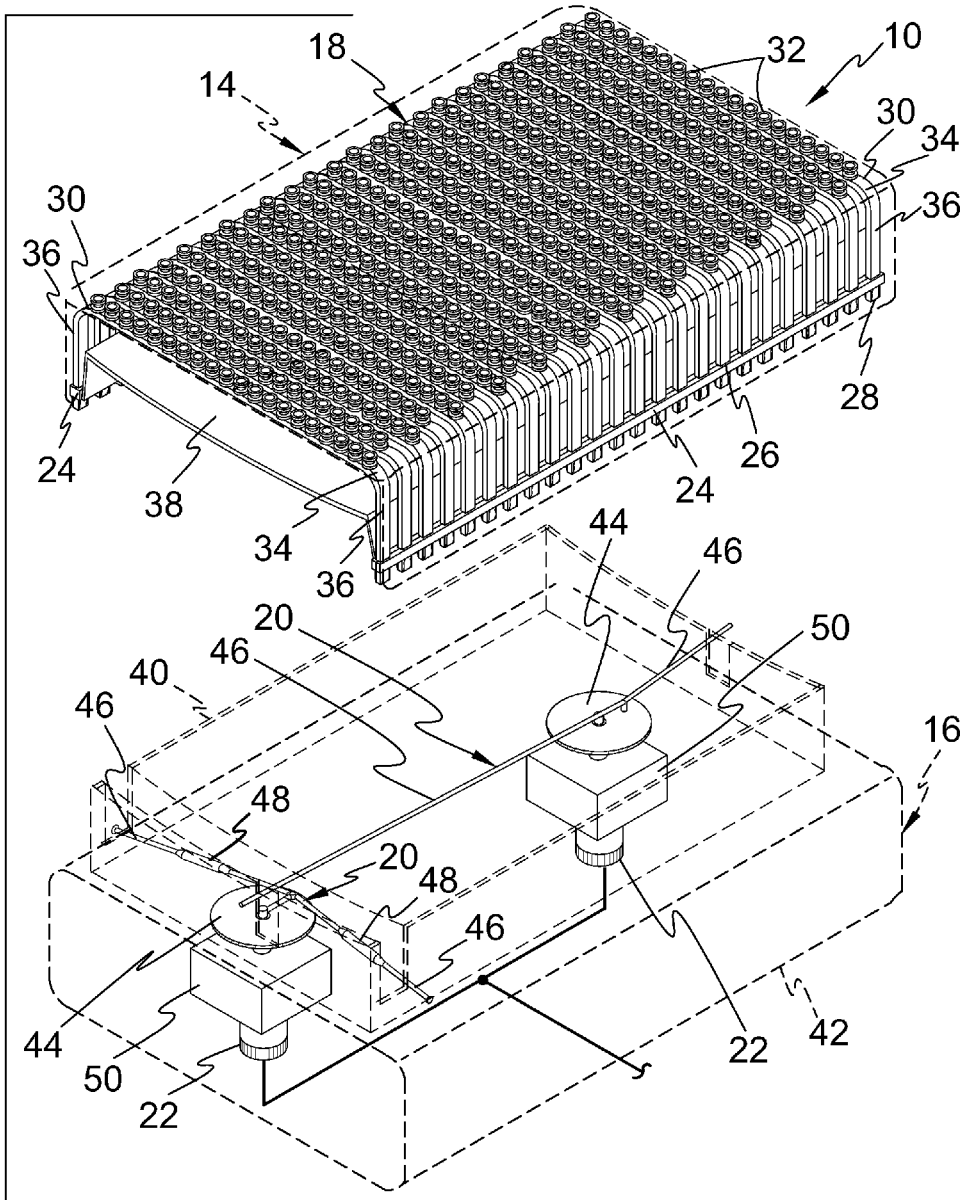
FIG. 2 is an exploded isometric view, with parts shown in phantom, of the present invention.

Referring to FIG. 2, shown is an exploded isometric view, with parts shown in phantom, of the present invention. The undulating bed 10 comprises the spring frame 18 and the bed frame support 16. The spring frame 18 has a pair of spring frame rails 24 with spaced apart apertures 26, each having a plurality of elastic bands 28 fastened under the apertures 26. A plurality of U-shaped springs 30 are also provided, having coil springs 32 fastened onto top portions 34, forming typical user support with leg portions 36 positioned within the spring frame rail apertures 26 and supported by the elastic bands 28. Fastened between the spring frame rails 24 is a free sliding curved member 38 that sits on a structural frame curved surface support 40 of the bed frame support 16. The bed frame support 16 comprises a bed frame 42 and the structural frame curved surface support 40, with the bed frame 42 housing the variable RPM motors 22 connected to pivot plates 44. The adjustable linkage arms 20 are fastened to the spring frame rails 24 and front and aft U-shaped springs 30, thereby simulating the undulating/rocking motion experienced on a boat.

Figure 3:
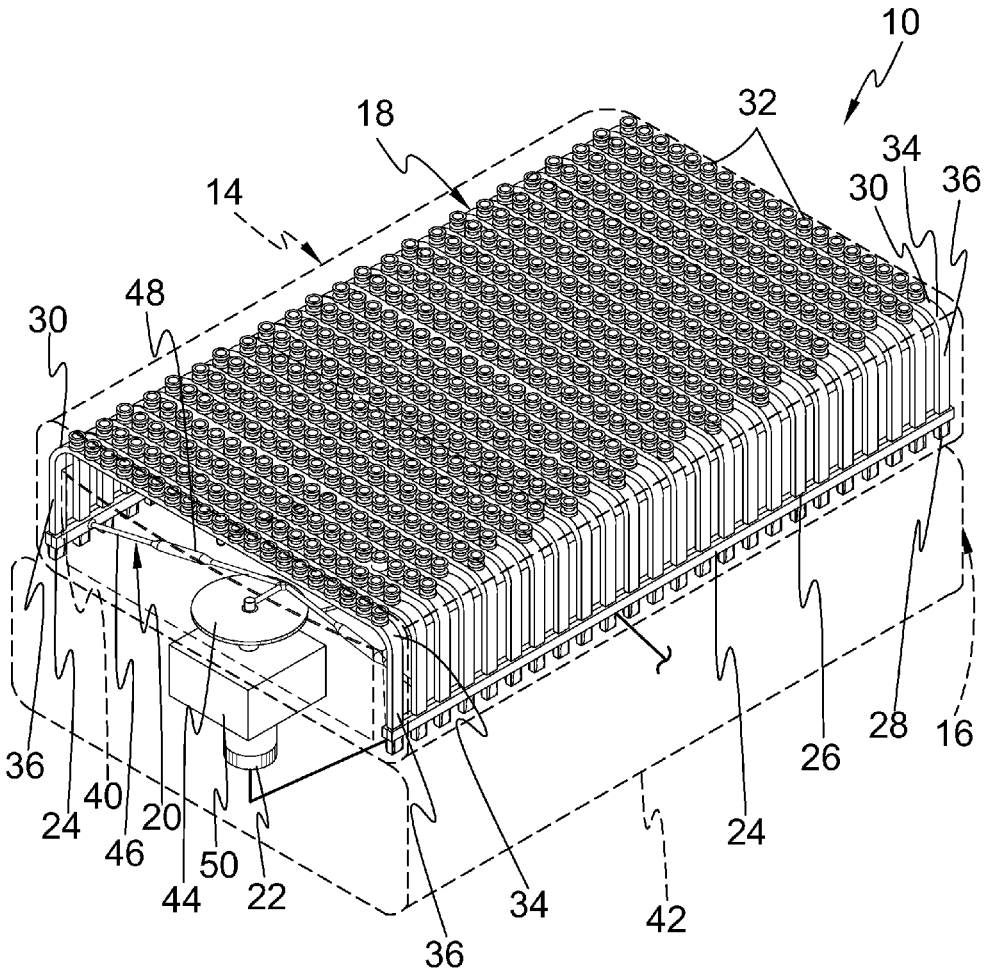
FIG. 3 is an assembled isometric view, with parts shown in phantom, of the present invention.

Referring to FIG. 3, shown is an assembled isometric view, with parts shown in phantom, of the present invention. The undulating bed 10 has the padded mattress 14 incorporating the spring frame 18, which is comprised of the plurality of U-shaped springs 30 constrained within apertures 26 of spaced apart spring frame rails 24 and is supported therein by a plurality of elastic bands 28 fastened under each of the spring rail apertures 26. Fastened between the spring frame rails 24 is the free sliding curved member 38 that sits on the structural frame curved surface support 40 of the bed frame support 16. Also attached to the spring frame rails 24 is an adjustable linkage arm 20, extending to the pivot plate 44 driven by the first variable RPM motor 22 with the pivot plate 44 providing side-to-side reciprocating motion for the spring frame rails 24, resulting in an undulating motion imparted on the U-shaped springs 30. The second variable RPM motor 22 is also connected through an adjustable linkage arm 20 to fore and aft U-shaped springs 30, thereby generating an undulating motion fore-to-aft. When the variable RPM motors 22 are simultaneously energized, the pivot plates 44 and adjustable linkage arms 20 produce the undulating/rocking motion, thereby emulating motion similar to that experienced on a boat with such motion intended as a sleep aid. The first pivot plate adjustable linkage arm 20 comprises tension rods 46 and elastic members 48 fixedly attached to the respective spring arm rails 24.

Figure 4:
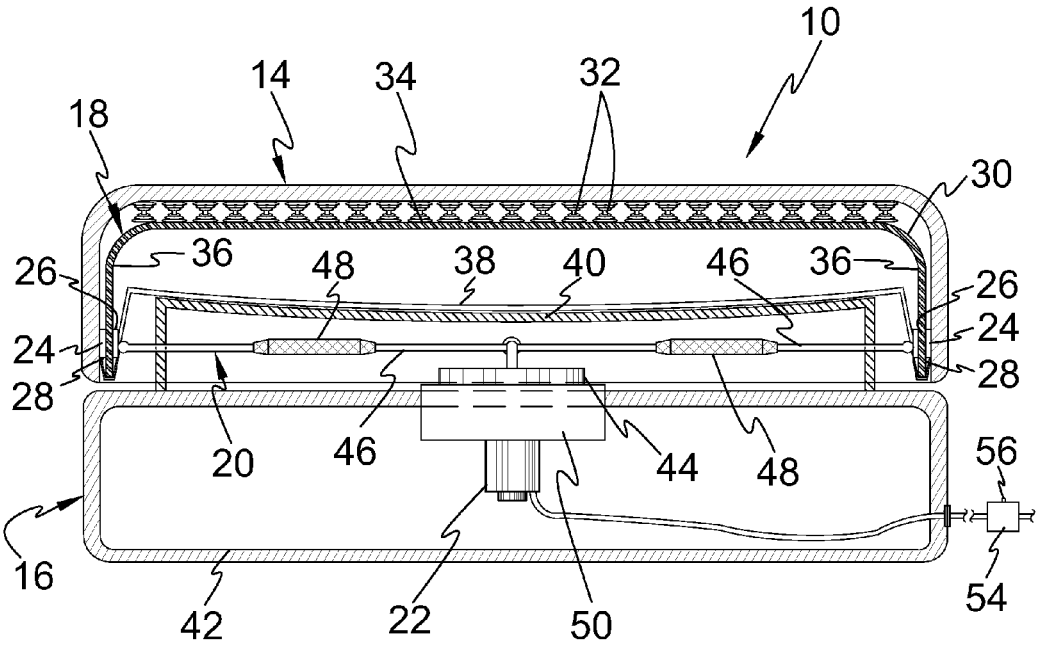
FIG. 4 is a cross sectional view of the present invention.

Referring to FIG. 4, shown is a cross sectional view of the present invention. The undulating bed 10 provides the padded mattress 14, housing an assembly of U-shaped springs 30 slidably movable via the pair of spring frame rails 24 reciprocated by variable RPM motors 22. The variable RPM motors 22, located within the bed frame 32, are connected to a gearbox 50 that drives a respective pivot plate 34 and adjustable linkage 20 having adjustable tension rods 46 incorporating elastic members 48. The adjustable tension rods 46 are fastened to the spring frame rail 24 on the left and right, providing lateral movement while the other adjustable tension rods 46 are fastened to a front U-shaped spring 30 and a back U-shaped spring 30 providing fore to aft motion. Working simultaneously, the movement simulates that is experienced on a boat with such movement intended as a sleep aid. A controller 54 energizes and de-energizes the variable RPM motors 22. The controller 54 contains a switch 56 to vary the RPM speed of the variable RPM motors 22.

Figure 5:
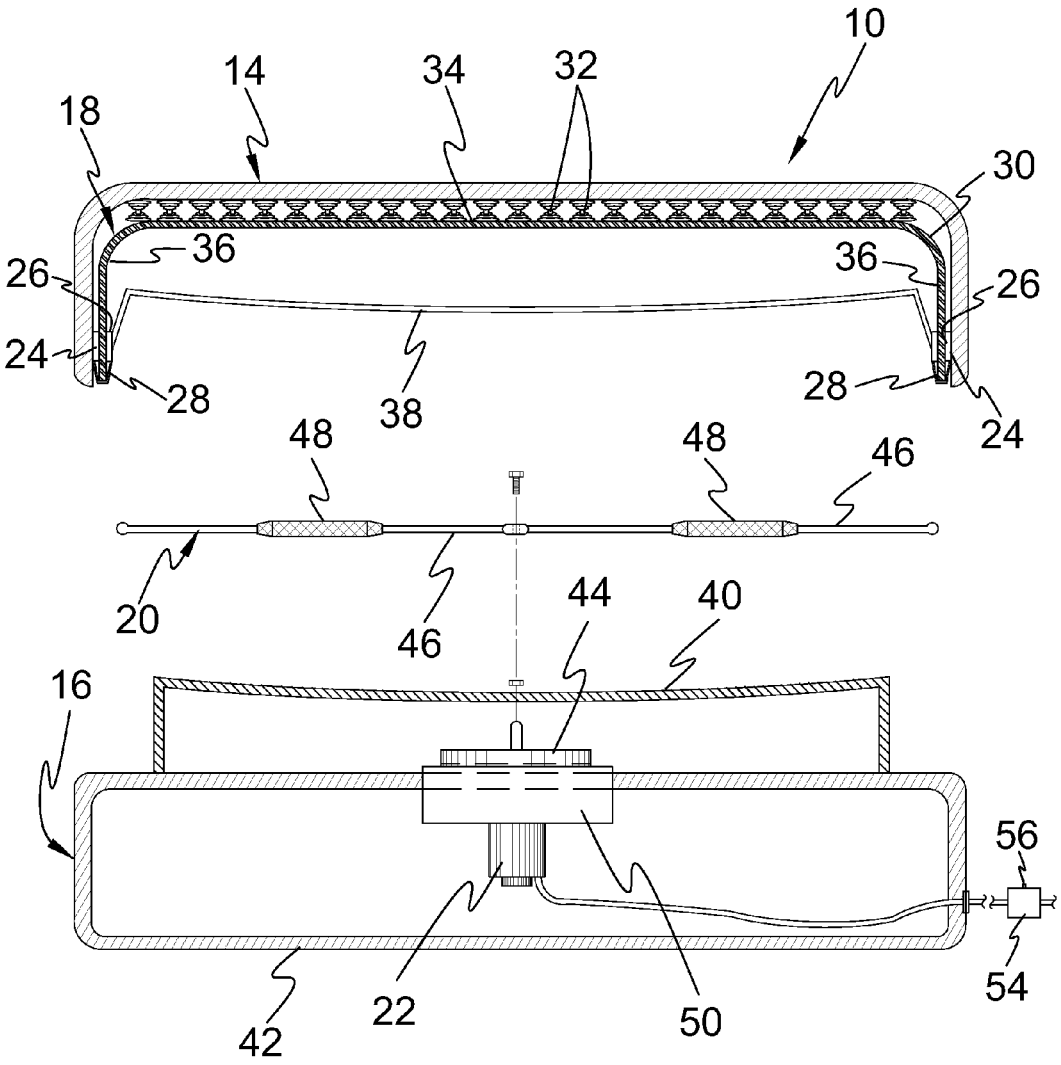
FIG. 5 is an exploded cross sectional view of the present invention.

Referring to FIG. 5, shown is an exploded cross sectional view of the present invention. The undulating bed 10 provides the padded mattress 14 housing an assembly of the U-shaped springs 30 slidably movable within the spring frame rails 24 reciprocated through linkage arms via variable RPM motors 22. The variable RPM motors 22, located within the bed frame 16 are connected through gear boxes 50, driving the pivot plates 44 having the adjustable linkage arms 20. One adjustable linkage arm 20 is connected transversely providing side-to-side motion, while the other is connected longitudinally to a front U-shaped spring 30 and a back U-shaped spring 30, providing fore-to-aft motion, so that simultaneously energizing both variable RPM motors 22 will provide an undulating/rocking motion simulating that is experienced on a boat, which is used as a sleep aid.

Figure 6:
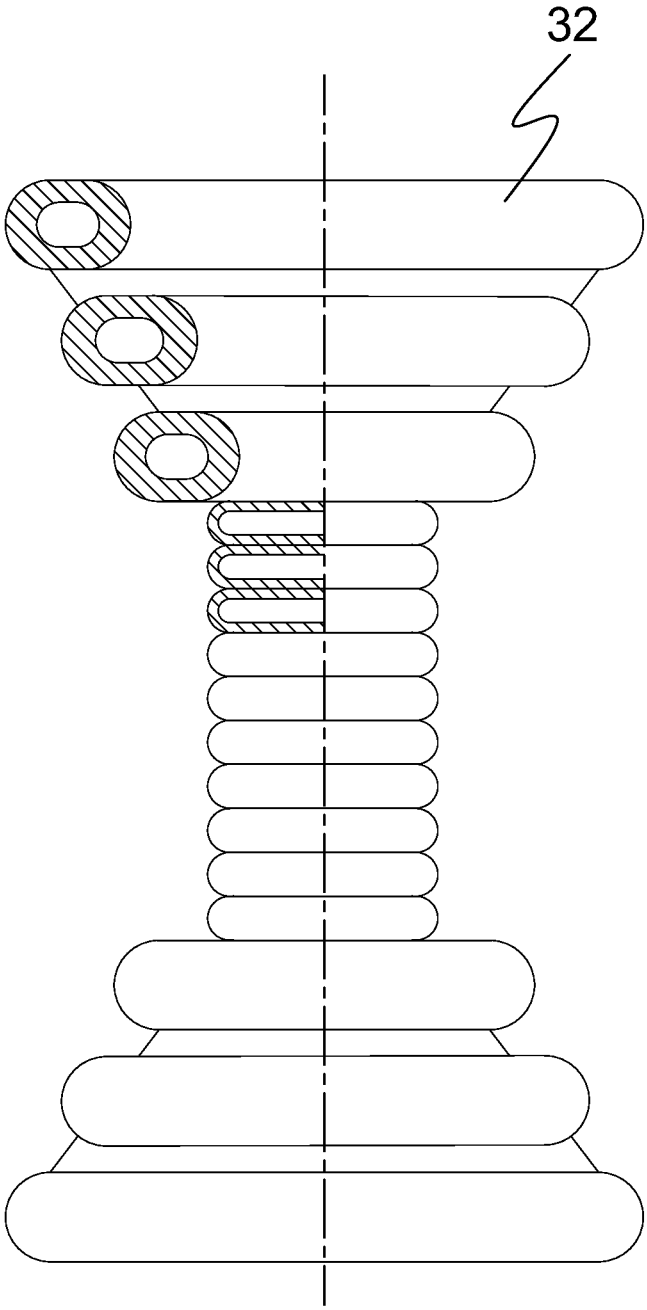
FIG. 6 is an enlarged elevational view, with parts shown in section, of a mattress support coil spring of the present invention.

Referring to FIG. 6, shown is an elevational view, with parts in section, of a mattress support coil spring of the present invention. The mattress support coil spring 32 is used in the plurality as typical user support springs within the padded mattress 14.

Figure 7:
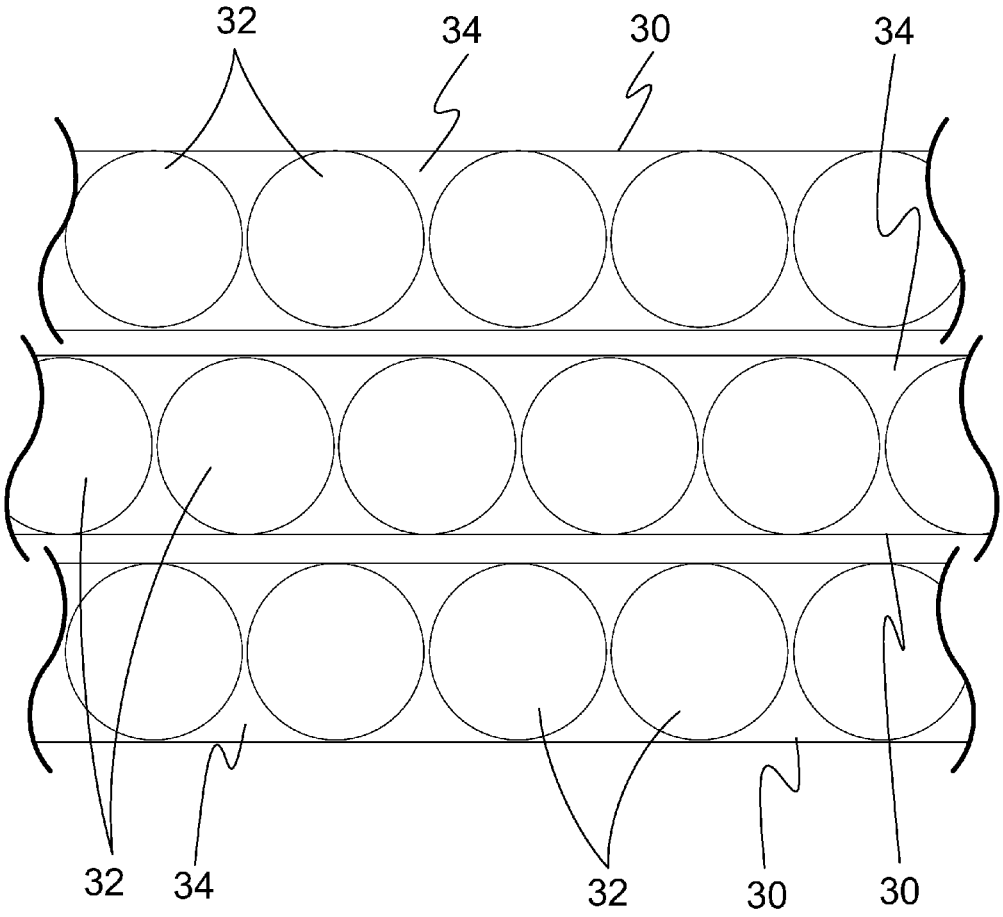
FIG. 7 is a top view of some of the mattress support coil springs positioned on the U-shaped springs.

Referring to FIG. 7, shown is a top view of some of the mattress support coil springs positioned on the U-shaped springs. The coil springs 32 are fixedly attached onto the respective top portion 34 of the U-shaped springs 30.

Figure 8:
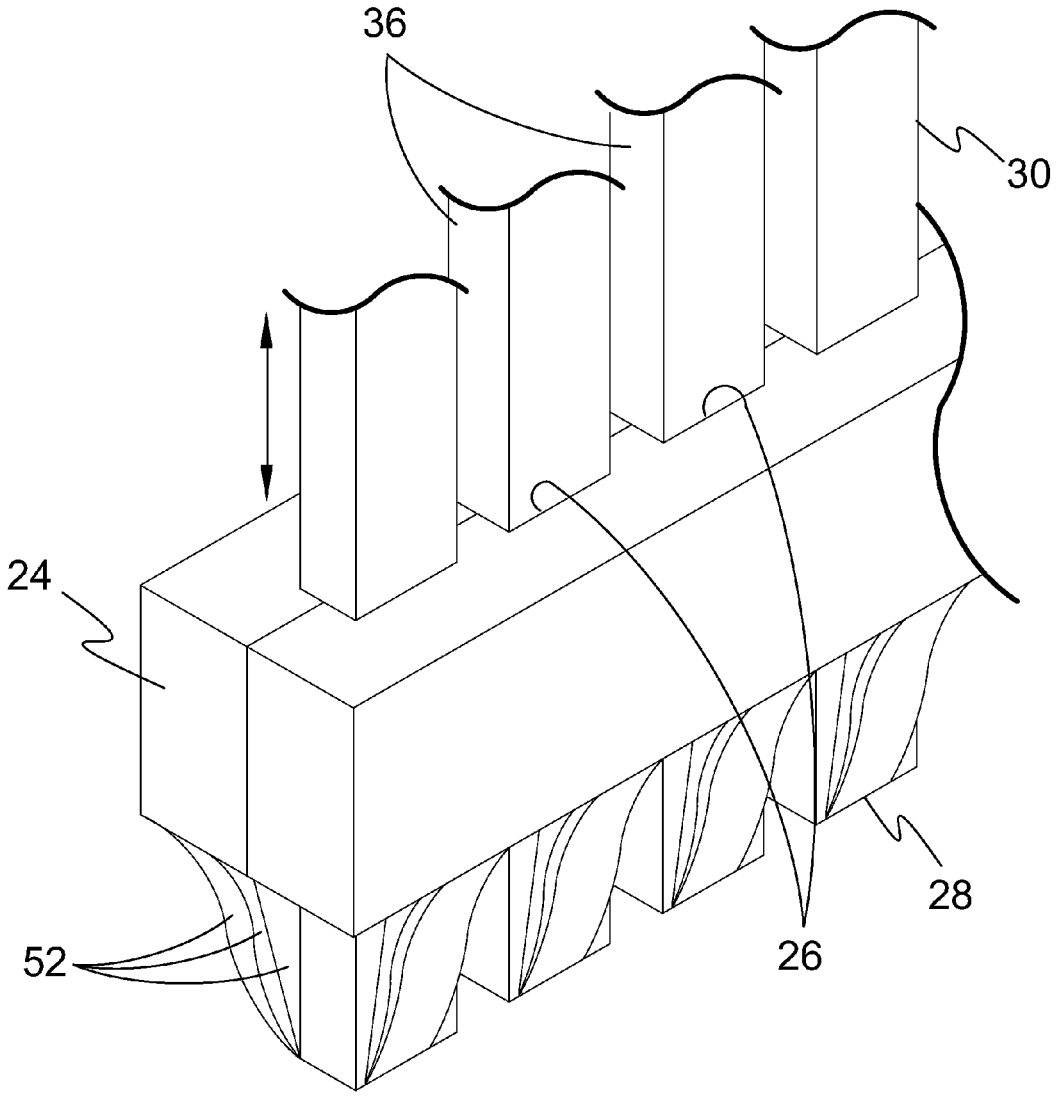
FIG. 8 is an isometric view of a portion of one spring frame rail constraining the leg portions of the U-shaped springs.

Referring to FIG. 8, shown is an isometric view of a portion of one spring frame rail constraining the leg portions of the U-shaped springs. The spring frame rail 24 has apertures 26 for receiving the leg portions 36 of the U-shaped springs 30 with the elastomeric or polymeric members 52 positioned across the base of each rail aperture 26, thereby individually supporting each of the leg portions 36 of the U-shaped springs 30.

What is claimed is:

1. An undulating bed which comprises:

a) a padded mattress comprising a spring frame therein, the spring frame comprising a pair of spring frame rails, in which each spring frame rail having a plurality of spaced apart apertures, the spring frame further comprises a plurality of U-shaped springs, whereby each U-shaped spring includes a top portion and two leg portions, and wherein the spring frame further comprises a plurality of elastic bands fastened under the apertures in the spring frame rails, whereby the leg portions of the U-shaped springs are positioned within the apertures in the spring frame rails and supported by the elastic bands;

b) a bed frame support positioned under the padded mattress; and c) means, within the bed frame support, for imparting an undulating/rocking motion to the padded mattress to substantially simulate motion experienced on a boat as a sleep aid to a user lying on the padded mattress.

2. The undulating bed as recited in claim 1, wherein the elastic bands are comprised of elastomeric/polymeric members.

3. The undulating bed as recited in claim 2, wherein the spring frame further comprises a plurality of coil springs fastened onto the top portions of the U-shaped springs, whereby the coil springs will form additional support to the user lying on the padded mattress.

4. The undulating bed as recited in claim 3, wherein the spring frame further comprises a free sliding curved member fastened between the spring frame rails.

5. The undulating bed as recited in claim 4, wherein the bed frame support comprises a bed frame.

6. The undulating bed as recited in claim 5, wherein the bed frame support further comprises a structural frame curved surface support on the bed frame, whereby the free sliding curved member will slide on the structural frame curved surface support.

7. The undulating bed as recited in claim 6, wherein the undulating/rocking motion means comprises two variable RPM motors housed within the bed frame.

8. The undulating bed as recited in claim 7, wherein the undulating/rocking motion means further comprises two gear boxes, whereby each gear box is coupled to one variable RPM motor.

9. The undulating bed as recited in claim 8, wherein the undulating/rocking motion means further comprises two pivot plates, whereby each pivot plate is coupled to one gear box.

10. The undulating bed as recited in claim 9, wherein the undulating/rocking motion means further comprises a plurality of adjustable linkage arms coupled to the two pivot plates, whereby a first set of adjustable linkage arms are connected transversely between the first pivot plate and the two side rails to provide side-to-side motion, while a second set of adjustable linkage arms are connected longitudinally between the second pivot plate and the front and back U-shaped springs to provide fore-to-aft motion when the two variable RPM motors are energized simultaneously.

11. The undulating bed as recited in claim 10, wherein the first set of adjustable linkage arms comprises a first pair of tension rods, in which each tension rod having an elastic member centrally located thereon.

12. The undulating bed as recited in claim 11, further comprising a controller to energize and de-energize the variable RPM motors.

13. The undulating bed as recited in claim 12, wherein the controller comprises a switch to vary the RPM speed of the variable RPM motors when the switch is employed.

* * * * *